United States Patent [19]

Netterstedt et al.

[11] 4,096,681

[45] Jun. 27, 1978

[54] FASTENER FOR RETAINING SHEET CLADDING

[75] Inventors: Sture Netterstedt; Bengt Lindstrand, both of Fagersta, Sweden

[73] Assignee: Rostfria Tak Aktiebolag, Fagersta, Sweden

[21] Appl. No.: 761,311

[22] Filed: Jan. 21, 1977

Related U.S. Application Data

[63] Continuation-in-part of Ser. No. 677,986, Apr. 19, 1976, abandoned.

[30] Foreign Application Priority Data

May 2, 1975 Sweden ..... 7505117

[51] Int. Cl.[2] ..... E04B 1/38

[52] U.S. Cl. ..... 52/713; 52/506; 52/714

[58] Field of Search ..... 52/520, 521, 528, 573, 52/506, 713, 714; 24/73 B; 403/402, 231

[56] References Cited

U.S. PATENT DOCUMENTS

| | | | |
|---|---|---|---|
| 1,810,287 | 6/1931 | Mahon et al. | 52/520 |
| 1,882,105 | 10/1932 | Wender | 52/520 |
| 3,858,373 | 1/1975 | Day et al. | 52/713 |

*Primary Examiner*—Kenneth J. Dorner

[57] ABSTRACT

A fastener for retaining sheet cladding, such as roof or wall sheeting, with outstanding flange joints, comprising an anchoring portion intended for attachment to a substructure, either directly to it or via an anchoring plate, and a fastening portion lying generally at right angles to the anchoring portion, which is intended to be united with the outstanding flange of the sheet. The attaching portion is made in hard-rolled thin sheet with a thickness of 0.15 mm or thinner, so that it can be seam-welded to the outstanding flanges in conjunction with welding these together without the continuity of the welding seam being broken, and the anchoring portion is reinforced by means of a doubling plate which preferably lies exterior to the anchoring portion.

2 Claims, 3 Drawing Figures

FASTENER FOR RETAINING SHEET CLADDING

RELATED APPLICATION

Figure 1:
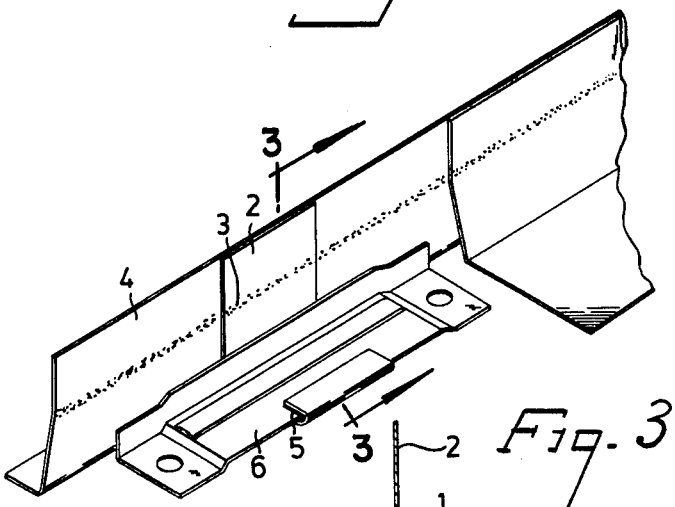

This is a continuation-in-part application of U.S. application Ser. No. 677,986, which was filed on Apr. 19, 1976, and now abandoned.

The present invention relates to a fastener for retaining sheet cladding such as roof or wall sheeting, with upstanding joints, comprising an anchoring portion intended for attachment to a substructure, either directly to it or via an anchoring plate, and a fastening portion lying mainly at right angles to the anchoring portion, and intended for attachment to the outstanding fold or flange on the sheet.

Different types of fasteners or so-called fastening clips for retaining sheet cladding on a substructure are known. These fastening clips can either be rigidly attached to the substructure or be arranged slidingly in relation to it. The gliding portion of the known fastening clips has the form of a set-square with a generally 90° angle between the bent-up legs. One of the legs is intended to be attached to the outstanding joint and the other leg is intended to be inserted under the anchoring plate of the sliding clip, and is so bent that it can grip round the edge of the anchoring plate and thus be attached to it. Even if this sliding clip has been found to be very effective and has enjoyed large use, it has the drawback that a special spot welding operation must be carried out to attach the outstanding leg of the gliding portion to the outstanding flange of the sheet. This spot weld must be carried out because the sheet thickness in the sliding portion is too great for it to be seam welded to the flange simultaneously with welding together the flanges of two adjacent sheets.

The present invention has the object of providing a fastener or a fastening clip for retaining sheet cladding, which makes it possible directly to weld the outstanding leg of the clip to the outstanding flanges of two adjacent sheets in conjunction with welding these two flanges without there being the need for any extra spot welding operation.

The fastener or fastening clip according to the invention is characterized in that its attaching portion is made in hardrolled thin sheet with a thickness of 0.15 mm or thinner, so that it can be seam welded to the outstanding flanges in conjunction with welding these together without breaking continuity in the welding seam, the anchoring portion being reinforced preferably by an exteriorly arranged doubling plate.

The problem in welding the attaching portion of the fastener to the outstanding flanges of the sheet is thus solved according to the invention by the attaching portion being made sufficiently thin for enabling seam welding to the outstanding flanges. The leg of the attaching portion which is either directly anchored to the substructure or to it via an anchoring plate has however insufficient strength if it consists of a plate which is sufficiently thin to be seamwelded at the flanges. To solve this problem the anchoring portion of the fastener is made in accordance to the invention with a reinforcement in the shape of a doubling plate lying preferably exteriorly to the anchoring portion.

Figure 3:
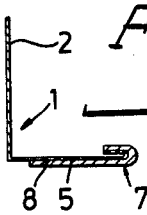
Figure 2:
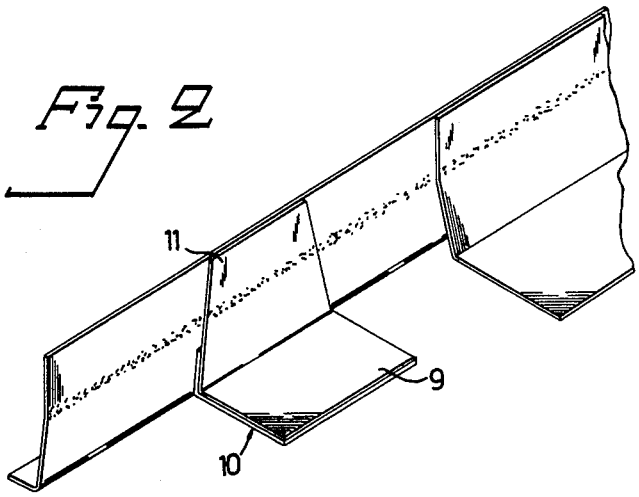

The invention will now be described in detail while referring to the attached drawing on which two embodiments of the invention are schematically illustrated as examples, where FIG. 1 shows a fastener made in the form of a sliding clip, while FIG. 2 shows a fastener intended for fixed anchoring to a substructure and, FIG. 3 is a sectional view of the fastener taken along line 3—3 of FIG. 1 and omitting the flange and anchoring plate to which it is connected.

The clip shown in FIG. 1 is of known type, but with the difference that the sliding portion 1 is made according to the principle of the present invention. It is thus apparent that the outstanding leg 2 of the sliding portion 1 is seam-welded 3 to an outstanding flange 4 of a sheet cladding, while the horizontal leg 5 which grips round the anchoring plate 6 is provided with an exterior doubling plate 7. This doubling plate makes the sliding portion sufficiently strong to withstand the stresses it is subject to, at the same time as the portion attached to the outstanding flange is sufficiently thin to be seam-welded to it in conjunction with seam-welding two adjacent flanges. The doubling plate 7 is attached to the horizontal leg of the sliding portion by spot welding 8, for example.

The fastener shown in FIG. 2 is intended to be attached directly to a substructure, its horizontal leg 9 having an exterior doubling plate 10 so that this portion of the fastener will be sufficiently strong, even if the vertical leg 11 is made sufficiently thin for seam-welding to an outstanding flange of a sheet in conjunction with welding together two adjacent flanges.

As will be seen from the drawing, the doubling plates are substantially thicker than the hard rolled sheet and of softer or more maleable material so as to be able to be folded or bent over to lie exterior to the anchoring plates. They may also be of such resiliency that they grasp the rolled sheet and are held firmly in place, although the weld securing them to the sheet is preferred. Suitable materials for the doubling plates are:

stainless steel Alsl 304 or Alsl 316 with tensile strength 50 hp/mm$^2$ min and hardness Vickers max 200.

suitable materials for the hard rolled sheet are:

stainless steel Alsl 302/304 with tensile strength ca: 1100 hp/mm$^2$ and hardness C-34.

The softness and thickness of such materials relative to the hard rolled sheet are as follows:

| Doubling Plates | | Hard rolled sheet |
|---|---|---|
| Softness | Vickers max 200 | C-34 |
| Thickness | 0.4 - 1.0 mm | 0.05 - 0.15 mm |

A suitable range of thickness for the hard-rolled one-layer thin sheet is 0.05 mm. to 0.15 mm.

The invention is not limited to both the embodiments described above, but also includes all the embodiments which can be conceived within the scope of the patent claims.

What is claimed is:

1. A composite fastener for retaining sheet cladding, such as a roof or wall sheeting, with outstanding flange joints, comprising a plate having an anchoring portion formed with a bent end intended for attachment to a substructure and a fastening portion lying generally at right angles to the anchoring portion, which is intended to be united with the outstanding flange of the sheet, said plate being made of hard-rolled one-layer thin sheet of stainless steel with a thickness of 0.05 to 0.15 mm., so that it can be seam-welded to the outstanding flanges in conjunction with welding these together without the continuity of the welding seam being broken, said anchoring portion being reinforced by means of a separate doubling plate of stainless steel, which is softer and thicker than the hard-rolled sheet forming said plate, said doubling plate lying on an exterior surface of the anchoring portion, curved about said bent end and being welded to said anchoring portion.

2. A fastener as claimed in claim 1, wherein said anchoring portion is attached to a substructure via an anchoring plate.

* * * * *